US006085617A

United States Patent [19]

Hu

[11] Patent Number: 6,085,617

[45] Date of Patent: Jul. 11, 2000

[54] HOOK SCREW DRIVER

[76] Inventor: Bobby Hu, P.O. Box 63-247, Taichung, Taiwan

[21] Appl. No.: 09/126,540

[22] Filed: Jul. 30, 1998

[51] Int. Cl.[7] ..... B25B 13/28

[52] U.S. Cl. ..... 81/98; 81/901

[58] Field of Search ..... 81/901, 489, 491, 81/487, 44, 177.1, 177.6, 98, 99, 111

[56] References Cited

U.S. PATENT DOCUMENTS

| | | | |
|---|---|---|---|
| 300,317 | 6/1884 | Griffith | 81/901 |
| 670,361 | 3/1901 | Sather | 81/901 |
| 693,406 | 2/1902 | Kydd | 81/901 |
| 5,964,132 | 10/1999 | Chen | 81/177.6 |

*Primary Examiner*—David A. Scherbel
*Assistant Examiner*—Joni B. Danganan
*Attorney, Agent, or Firm*—Charles E. Baxley, Esq.

[57] ABSTRACT

A hook screw driver includes an upper body and a lower body. One of the upper body and the lower body includes a retaining section having a pattern formed thereon. The pattern is constructed by a number of spaced blocks that constitute a plurality of grooves adapted to securely retain a hook portion of a hook screw. An engaging device is provided for disengagably engaging the upper body with the lower body. When the engaging device is in a first position, the upper body and the lower body are retained in a disengaged status such that the upper body and the lower body is rotatable relative to each other to reveal the retaining section for receiving the hook portion of the hook screw. When the engaging device is in a second position, the upper body and the lower body are retained in a closed, non-rotatable relationship to securely hold the hook portion of the hook screw.

9 Claims, 12 Drawing Sheets

HOOK SCREW DRIVER

BACKGROUND OF THE INVENTION

1. Field of the Invention

The present invention relates to a hook screw driver that may be applied to hook screws of various sizes.

2. Description of the Related Art

Hook screws are widely used on wooden walls for hanging objects. The user often use a pair of pliers to clamp a hook screw when mounting the hook screw to a wooden wall, which is inconvenient and may cause damage to the hook screw. Although devices have been proposed to securely hold hook screws, the holding effect is found unsatisfactory. In addition, the conventional devices cannot be applied to hook screws of various sizes as there are many shapes and sizes in the hook portion of the hook screw. The present invention is intended to provide an improved hook screw driver to solve these problems.

SUMMARY OF THE INVENTION

It is a primary object of the present invention to provide an improved hook screw driver that can be applied to securely hold hook screws of various sizes so as to mount the hook screws to a wooden wall.

In accordance with one aspect of the invention, a hook screw driver comprises an upper body and a lower body. One of the upper body and the lower body includes a retaining section having a pattern formed thereon. The pattern is constructed by a plurality of spaced blocks that constitute a plurality of grooves adapted to securely retain a hook portion of a hook screw. An engaging means is provided for disengagably engaging the upper body with the lower body. The engaging means is movable between a first position in which the upper body and the lower body are retained in a disengaged status such that the upper body and the lower body is rotatable relative to each other to reveal the retaining section for receiving the hook portion of the hook screw and a second position in which the upper body and the lower body are retained in an engaged relationship to securely hold the hook portion of the hook screw.

In accordance with a second aspect of the invention, a hook screw driver comprises an upper body and a lower body. One of the upper body and the lower body includes a disc rotatably mounted thereon. The disc includes a first retaining section having a first pattern formed thereon and a second retaining section having a second pattern formed thereon and different from the first pattern. Each of the first pattern and the second pattern is constructed by a plurality of spaced blocks that constitute a plurality of grooves adapted to securely retain a hook portion of a hook screw. An engaging means is provided for disengagably engaging the upper body with the lower body. The engaging means is movable between a first position in which the upper body and the lower body are retained in a disengaged status such that the upper body and the lower body is rotatable relative to each other to reveal the retaining section for receiving the hook portion of the hook screw and a second position in which the upper body and the lower body are retained in an engaged relationship to securely hold the hook portion of the hook screw.

In accordance with a third aspect of the invention, a hook screw driver comprises an upper body and a lower body. The lower body includes two ends and a mediate section that includes a through hole and two receptacles formed on two sides of the through hole, respectively. A first disc and a second disc are respectively, rotatably mounted on the two ends of the lower body. The first disc includes a first retaining section and a second retaining section formed on an upper side thereof. The second disc includes a third retaining section and a fourth retaining section formed on an upper side thereof. The first retaining section, the second retaining section, the third retaining section and the fourth retaining section respectively have a first pattern, a second pattern, a third pattern, and a fourth pattern formed thereon and different from one another. Each of the first pattern, the second pattern, the third pattern, and the fourth pattern is constructed by a plurality of spaced blocks that constitute a plurality of grooves adapted to securely retain a hook portion of a hook screw.

The upper body includes a compartment in an upper side thereof and defined by a bottom wall, two lateral walls, and two end walls. The bottom wall includes a hole. An elastic member is mounted in the compartment and has two ends respectively attached to the end walls of the compartment. The elastic member further includes a central opening, two mutually facing extensions, and four legs respectively extended from four corners thereof.

A ball is mounted in each receptacle, and a spring is mounted in each receptacle for biasing the ball upwardly. A sleeve is slidably received in the through hole of the lower body and includes an upper end extended into the compartment of the upper body via the hole of the upper body. The sleeve includes an outer annular groove defined in the upper end thereof.

A plug is slidably mounted in the sleeve and includes an upper end secured to the upper body to move therewith. Two steel balls are partially yet disengagably received in the outer annular groove of the sleeve and restrained by the extensions of the elastic member. A cover is mounted to enclose the compartment of the upper body and includes a chamber. An actuating plate is slidably received in the chamber of the cover and engaged with the upper end of the sleeve.

When the actuating member and the lower end of the plug are pressed, the steel balls are disengaged from the annular groove of the sleeve and thus causes disengagement of the upper body from the lower body to allow relative rotational movement therebetween to reveal at least one of the first retaining section, the second retaining section, the third retaining section, and the fourth retaining section and to allow rotational movements of the first disc and the second disc relative to the lower body. When the steel balls are partially received in the annular groove of the sleeve, the upper body and the lower body are engaged with each other such that relative rotational movement therebetween is prevented from, and rotational movements of the first disc and the second disc relative to the lower body are also prevented from.

The first disc includes a tubular member formed on an underside thereof, and one of the two ends of the lower body includes a through hole for rotatably receiving the tubular member. A spring is received in the through hole of the lower body and around the tubular member, and an end cap mounted to enclose the through hole. The end cap includes a snapping fastener extended into the through hole of the lower body.

The second disc includes a second tubular member formed on an underside thereof, and the other one of the two ends of the lower body includes a second through hole for rotatably receiving the second tubular member. A second spring is received in the second through hole of the lower body and around the second tubular member, and a second end cap mounted to enclose the second through hole. The second end cap includes a second snapping fastener extended into the second through hole of the lower body.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
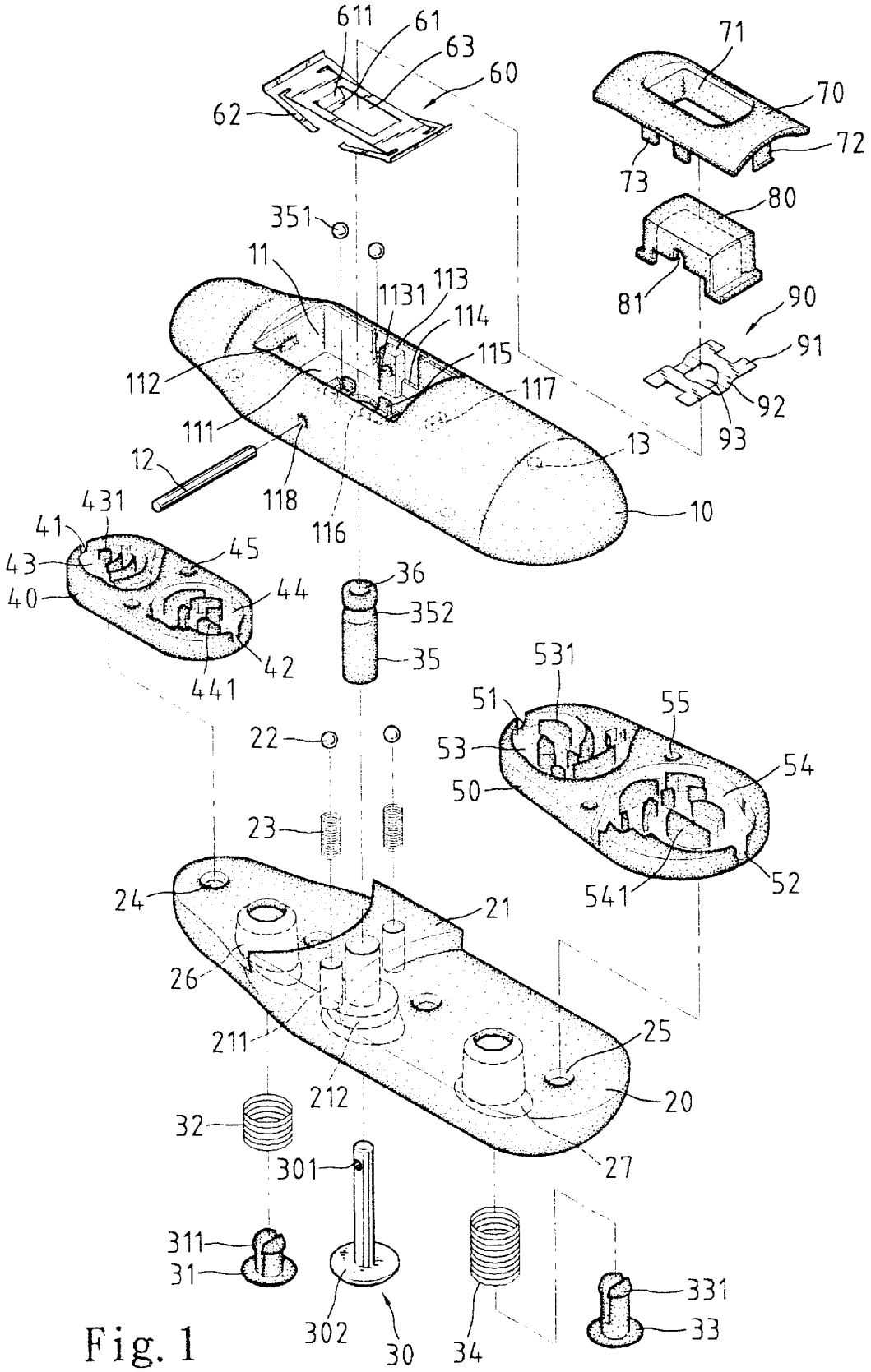
FIG. 1 is an exploded perspective view of a hook screw driver in accordance with the present invention.
Figure 2:
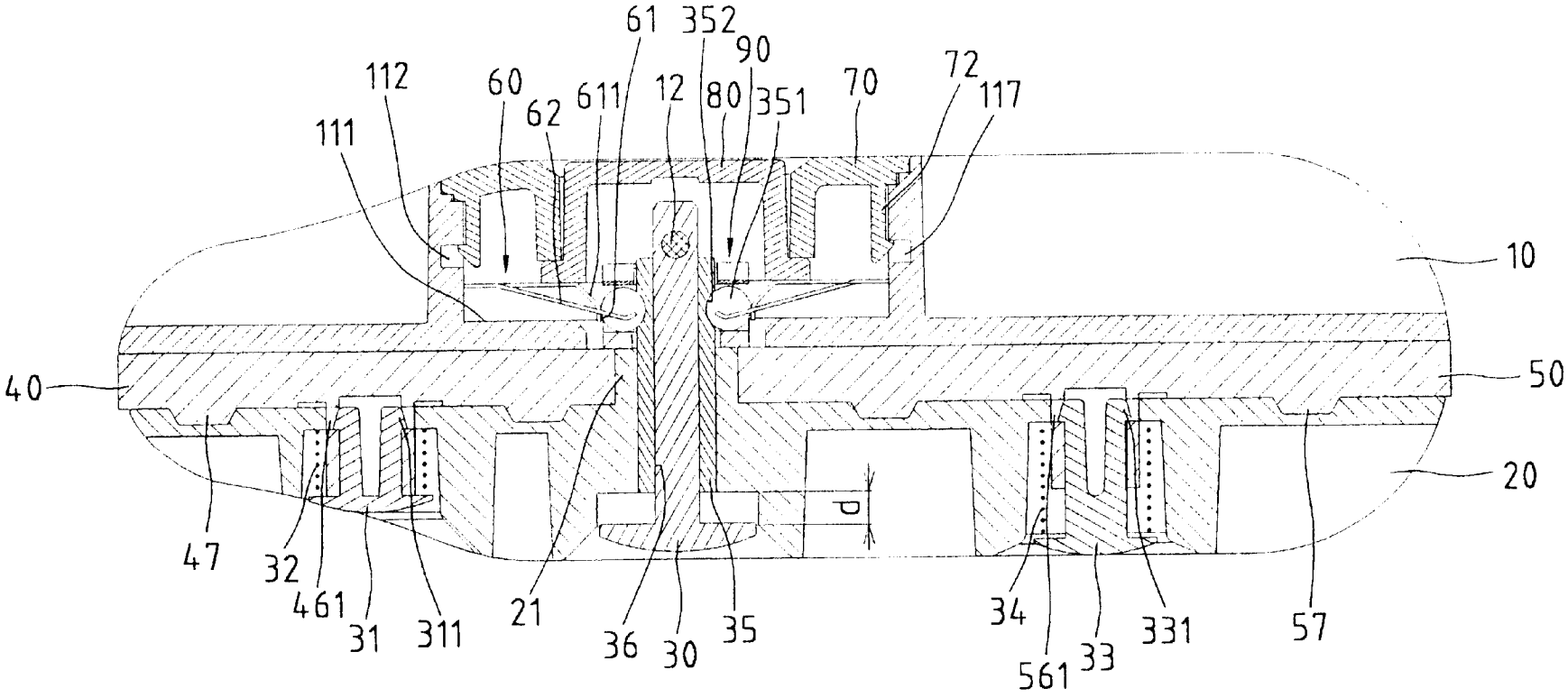
FIG. 2 is a longitudinal sectional view of the hook screw driver.
Figure 4:
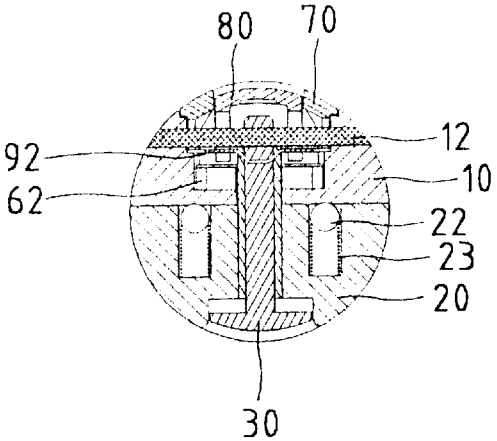
FIG. 4 is a sectional view taken along line 4—4 in FIG. 3.

Referring to the drawings and initially to FIGS. 1 and 2, a hook screw driver in accordance with the present invention generally includes an upper body 10 and a lower body 20. The lower body 20 includes a protruded section 21 formed on an upper side of a mediate section thereof. The protruded section 21 includes a through hole 212 and two receptacles 211 formed on two sides of the through hole 212, respectively. In each receptacle 211, a ball 22 and a spring 23 for biasing the ball 22 upwardly are mounted. The lower body 20 further includes a second through hole 26 and a third through hole 27 respectively defined in two ends thereof, which will be described later.

Figure 14:
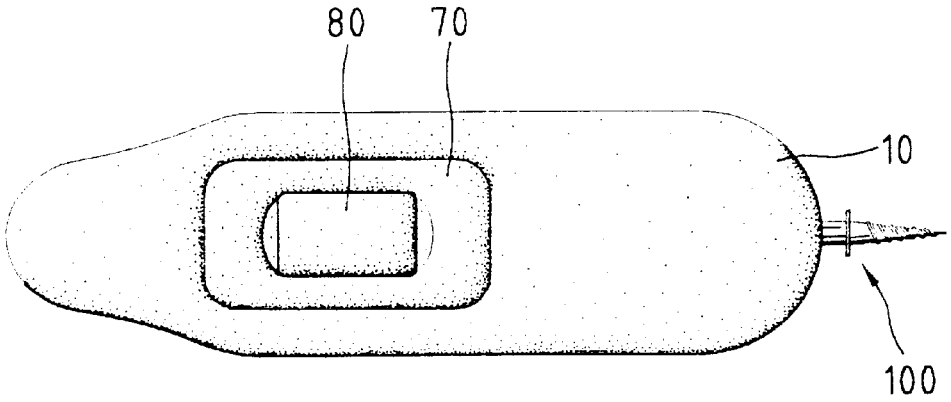
FIG. 14 is a schematic top view similar to FIG. 13, wherein the upper body is rotated through 90° to securely hold the hook screw.
Figure 15:
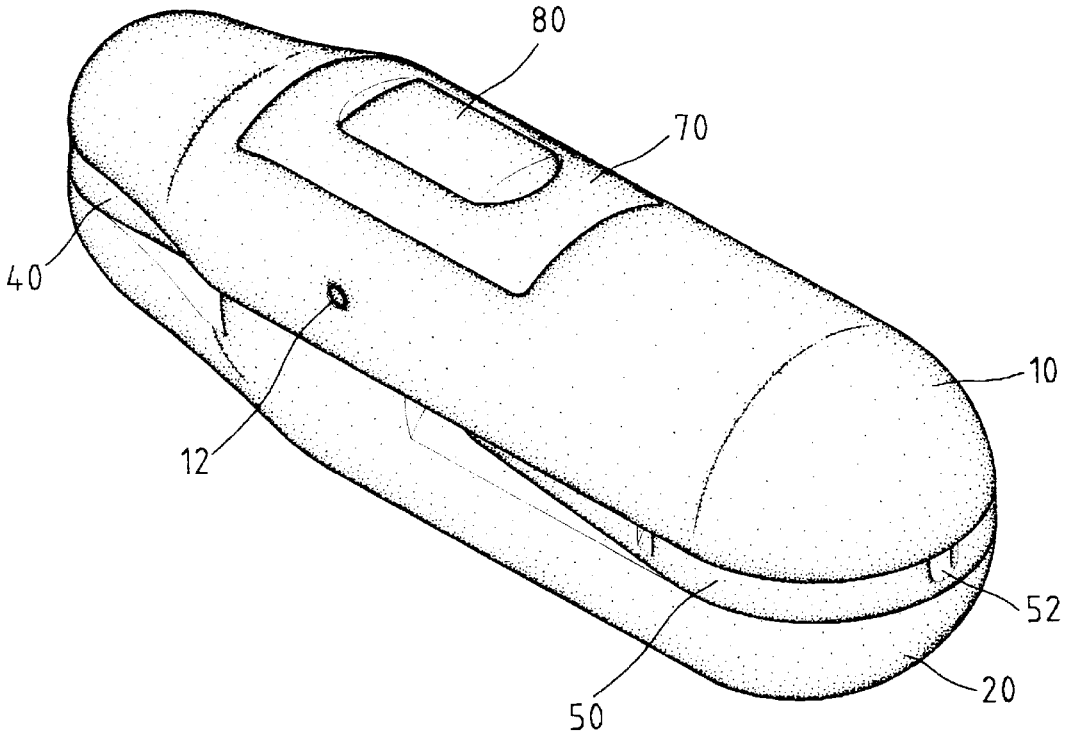
FIG. 15 is a perspective view of the hook screw driver of the present invention.
Figure 16A:
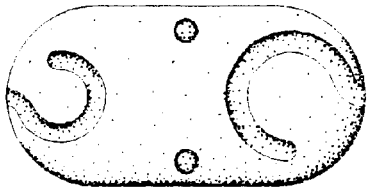
FIGS. 16A–16E are schematic top views each illustrating a pattern element that constitutes the pattern in FIG. 16.
Figure 16D:
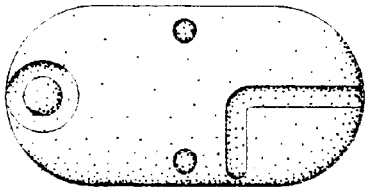
Figure 16B:
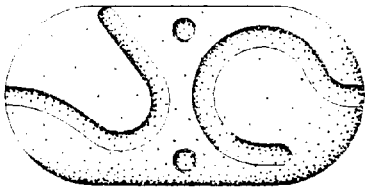
Figure 16E:
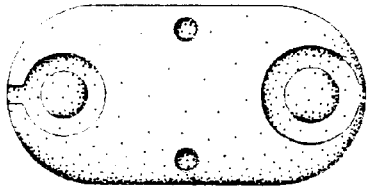
Figure 16C:
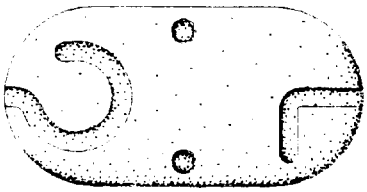
Figure 16:
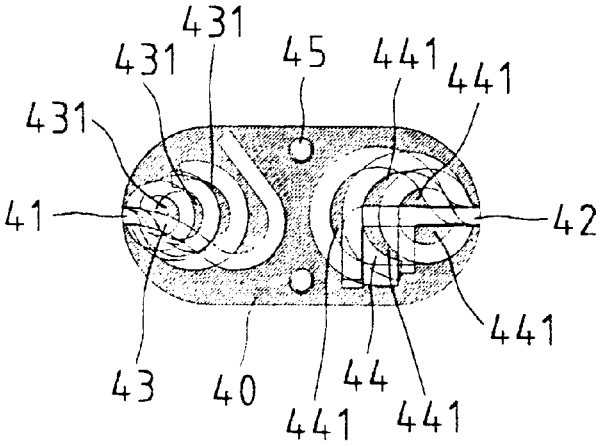
FIG. 16 is a schematic top view illustrating a pattern on the first disc.
Figure 17A:
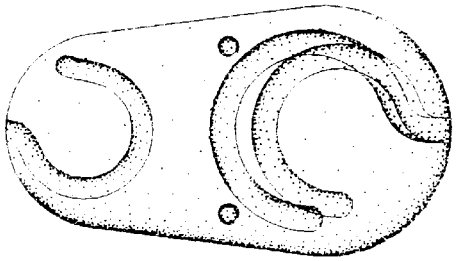
FIGS. 17A–17E are schematic top views each illustrating a pattern element that constitutes the pattern in FIG. 17.
Figure 17D:
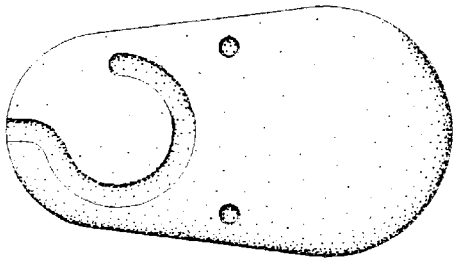
Figure 17B:
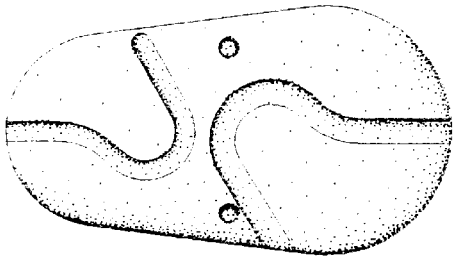
Figure 17E:
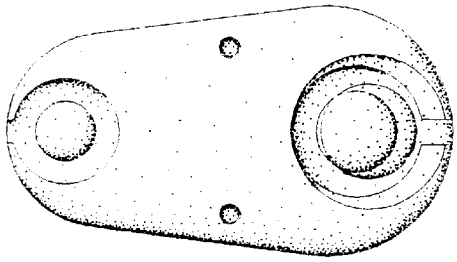
Figure 17C:
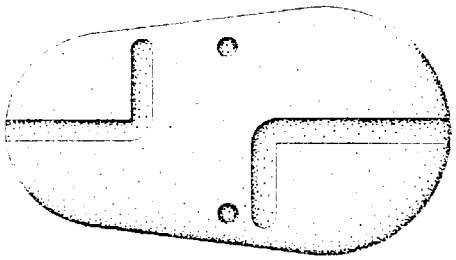
Figure 17:
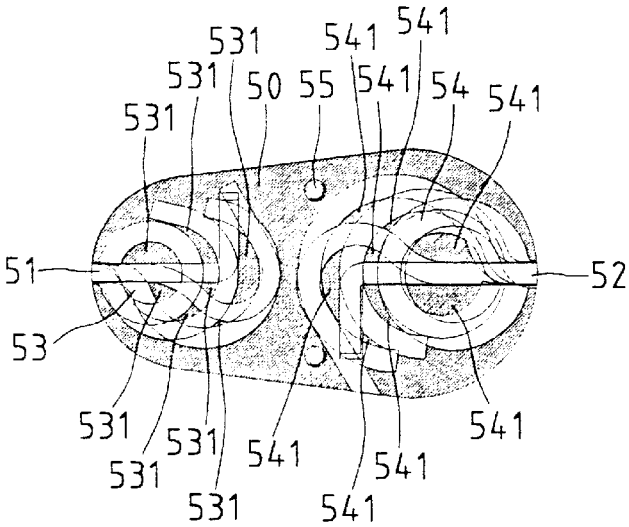
FIG. 17. is a schematic top view illustrating a pattern on the second disc.

A first disc 40 and a second disc 50 are respectively, rotatably mounted on the two ends of the lower body 10. Each disc 40, 50 includes two notches 41 and 42; 51 and 52 respectively defined in two ends thereof. In addition, the first disc 40 includes a first retaining section 43 and a second retaining section 44 formed on an upper side thereof, while the second disc 50 includes a third retaining section 53 and a fourth retaining section 54 formed on an upper side thereof. The first retaining section 43, the second retaining section 44, the third retaining section 53, and the fourth retaining section 54 respectively have a first pattern, a second pattern, a third pattern, and a fourth pattern formed thereon and different from one another. Each of the first pattern, the second pattern, the third pattern, and the fourth pattern is constructed by a plurality of spaced blocks 431, 441, 531, 541 that constitute a plurality of grooves (not labeled) adapted to securely retain a hook portion of a hook screw 100 (FIG. 14) of the size of which may vary in a wide range. FIG. 16 illustrates an example of the first pattern constructed by a number of spaced blocks 431 as well as an example of the second pattern constructed by a number of spaced blocks 441. It is appreciated that the first pattern is a combination of the pattern elements respectively shown in the left parts of FIGS. 16A–16E, while the second pattern is a combination of the pattern elements respectively shown in the right parts of FIGS. 16A–16E. Similarly, the third pattern is a combination of the pattern elements respectively shown in the left parts of FIGS. 17A–17E, while the fourth pattern is a combination of the pattern elements respectively shown in the right parts FIGS. 17A–17E. It is further appreciated that the patterns shown in FIGS. 16, 16A–16E, 17, and 17A–17E are provided for illustrative purpose only and shall not cause any limitation to the invention. Thus, the hook screw driver of the present invention may be applied to numerous kinds of hook screws as each of the first, second, third, and fourth retaining sections 43, 44, 53, and 54 may be applied to a number of hook screws of various sizes in different ranges.

Figure 1B:
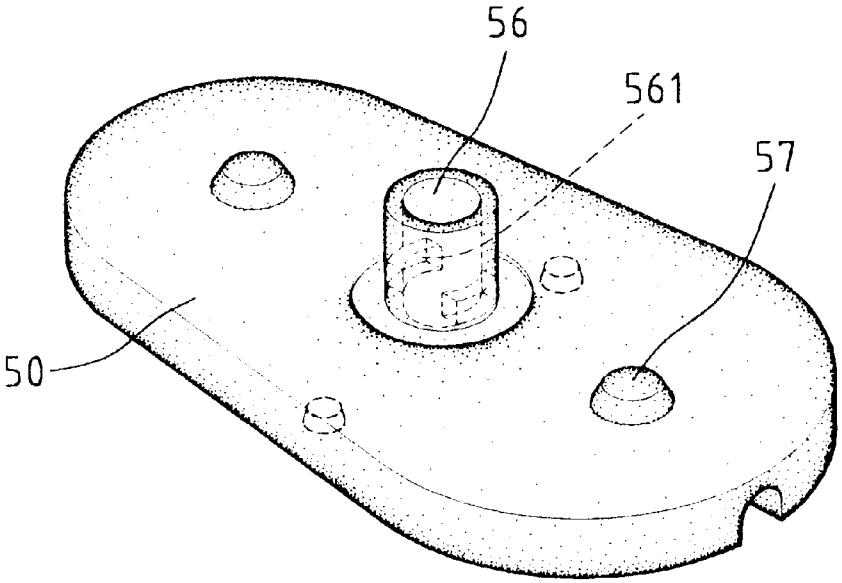
FIG. 1B is a perspective view illustrating an underside of a second disc of the hook screw driver in accordance with the present invention.
Figure 1A:
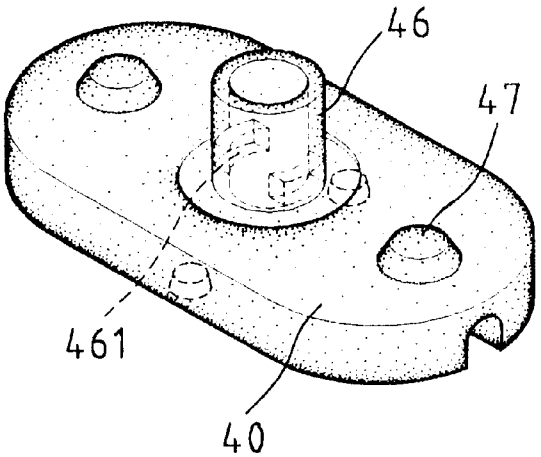
FIG. 1A is a perspective view illustrating an underside of a first disc of the hook screw driver in accordance with the present invention.

Referring to FIG. 1A, the first disc 40 further includes a tubular member 46 formed on an underside thereof and rotatably extended through the second through hole 26. In addition, a spring 32 is received in the through hole 26 and around the tubular member 46, and an end cap 31 mounted to enclose the through hole 26. The end cap 31 includes a snapping fastener 311 extended into the through hole 26 of the lower body 20, as shown in FIG. 2. The tubular member 46 includes two diametrically disposed grooves 461 (FIG. 1) defined in an inner periphery thereof for securely receiving a distal end of the snapping fastener 311. The first disc 40 further includes two conic protrusions 47 formed on the underside thereof and respectively, fittingly received in two conic depressions 24 in the upper side of the lower body 10

Similarly, as shown in FIG. 1B, the second disc 50 includes a tubular member 56 formed on an underside thereof and rotatably extended through the third through hole 27 of the lower body 20. In addition, a spring 34 is received in the through hole 27 and around the tubular member 56, and an end cap 33 is mounted to enclose the through hole 27. The end cap 33 includes a snapping fastener 331 extended into the through hole 27 of the lower body 20. The tubular member 56 includes two diametrically disposed grooves 561 (FIG. 1) defined in an inner periphery thereof for securely receiving a distal end of the snapping fastener 331. The second disc 50 further includes two conic protrusions 57 formed on the underside thereof and respectively, fittingly received in two conic depressions 25 in the upper side of the lower body 10.

Turning back to FIG. 1, an upper side of the upper body 10 includes a compartment 11 that is defined by a bottom wall 111, two lateral walls 113, and two end walls. The bottom wall 111 includes a hole 116, and two spaced retaining walls 115 are provided on each side of the hole 116. The lateral walls 113 include aligned holes 118 and 1131. Each lateral wall 113 further includes a ledge 114. The end walls include aligned grooves 112 and 117, which will be described later.

A press plate 90 is mounted in the compartment 11 of the upper body 10 and includes four corners 91 that bear against the ledges 114 of the upper body 10, a central hole 93, and a recessed mediate section 92. A cover 70 is provided for housing the compartment 11 of the upper body 10 and includes a hook fastener 72 provided on each of two ends thereof for engaging with the grooves 112 and 117 of the upper body 10, respectively. The cover 70 further includes two legs 73 extending downwardly from each of two lateral sides thereof to bear against the lateral walls of the compartment 11 to provide additional support for the cover 70 in addition to the engagement between the hook fasteners and the grooves 112 and 117. A hollow actuating member 80 is slidably mounted in a central chamber 71 defined in the cover 70 and includes a notch 81 defined in each lateral side thereof, which will be described later.

Also mounted in the compartment 11 is an elastic member 60 that is substantially rectangular and has two ends respectively attached to the end walls of the compartment 11 (FIG. 2). The elastic member 60 further includes a central opening 63 and four elastic legs 62 respectively extended inwardly and downwardly from four corners thereof. In addition, two extensions 61 are respectively extended from two mutually facing edges that define a portion of the central opening 63 and each have an inclined surface 611.

A plug 30 is slidably mounted in the through hole 212 of the lower body 20 and includes an enlarged head 302 and a transverse hole 301 defined in an upper end thereof. A sleeve 35 is also mounted in the through hole 212 and includes a central hole 36 through which the plug 30 is extended. The sleeve 35 includes an outer annular groove 352 defined an upper portion thereof. A pin 12 is extended through the through hole 301 of the plug 30 and the aligned holes 118 and 1131 of the upper body 10 to secure the plug 30 to the upper body 10.

In assembly, referring to FIGS. 1 and 2, the tubular member 46 of the first disc 40 is extended through the through hole 26 of the lower body 20, while the conic protrusions 47 are fittingly received in the conic depressions 24. The spring 32 and the end cap 31 are mounted into the through hole 26 to retain the first disc 40 in position. It is appreciated that the distal end of the snapping fastener 311 is engaged with the grooves 461 defined in the tubular member 46 to prevent from disengagement of the first disc 40 from the lower body 20, best shown in FIG. 2. The second disc 50 is likewise mounted to the lower body 20 and retained in position by corresponding elements, which is self-explanatory and therefore not further described.

The balls 22 and springs 23 are inserted into the receptacles 211, and the upper body 10 and the lower body 20 are then engaged together, in which four knurls 13 provided on an underside of the upper body 10 are respectively, fittingly received in depressions 45 and 55 respectively defined in the upper sides of the first and second discs 40 and 50.

The sleeve 35 is mounted in the through hole 212 of the lower body 20 with an upper end thereof extended beyond the hole 116 of the upper body 10, and the plug 30 is extended through the sleeve 35. The elastic member 60 is then mounted into the compartment 11 of the upper body 10, in which the extensions 61 of the elastic member 60 bears against the spaced retaining walls 115. A steel ball 351 is placed into a space between each pair of retaining walls 115 and partially received in the annular groove 352 of the sleeve 35 and bears against the associated extension 61. Next, the four legs 91 of the press plate 90 are attached to the ledges 114 of the lateral walls 113, while the recessed section 92 bears against upper portions of the two steel balls 351. Thereafter, the pin 12 is extended through the holes 118 and 1131 as well as the transverse hole 301 of the plug 30. The actuating member 80 is placed into the compartment 11, and the cover 70 is then mounted to the compartment 11, in which the hook fasteners 72 respectively engaged with the grooves 112 and 117 of the upper body 10, while the actuating member 80 is vertically slidable in the chamber 71 of the cover 70. It is appreciated that vertical movement of the actuating member 80 shall not be affected by the pin 12 due to provision of the notches 81. Thus, assembly of the hook screw driver of the present invention is accomplished, and the assembled hook screw driver is shown in FIGS. 2, 3, 4, and 15.

Figure 3:
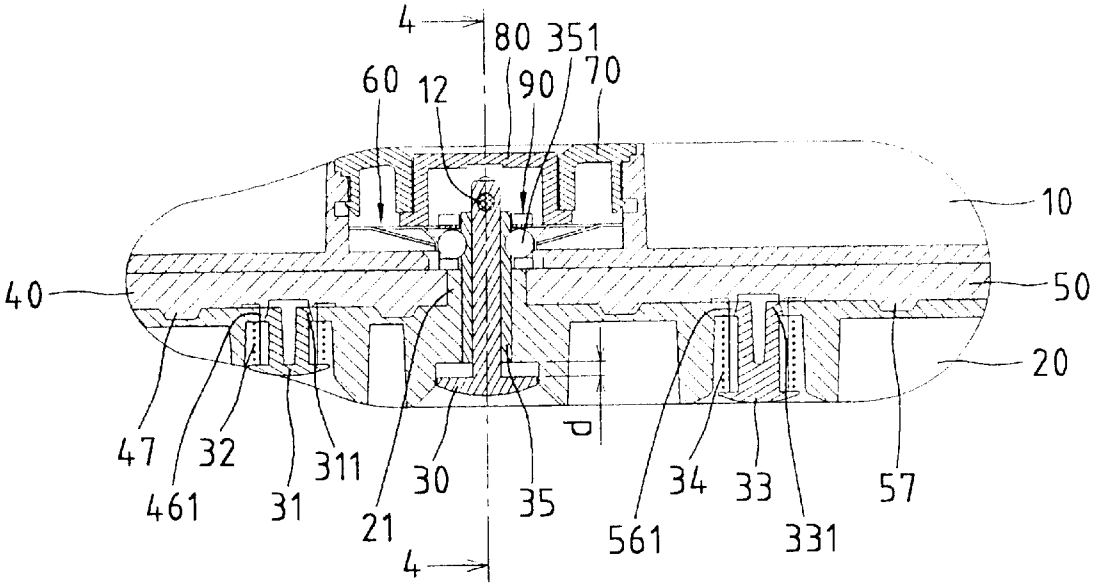
FIG. 3 is a schematic side view, partly in section, of the hook screw driver in a status for securely clamping a hook screw.
Figure 6:
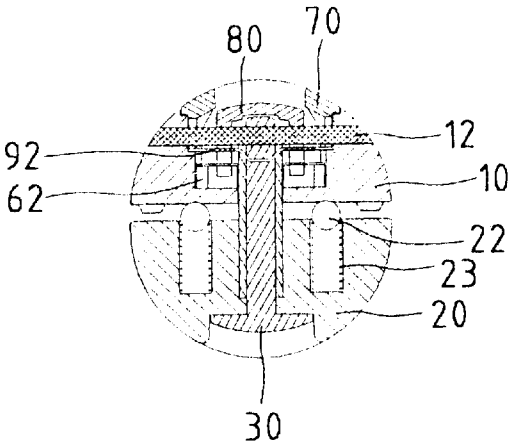
FIG. 6 is a sectional view taken along line 6—6 in FIG. 5.
Figure 5:
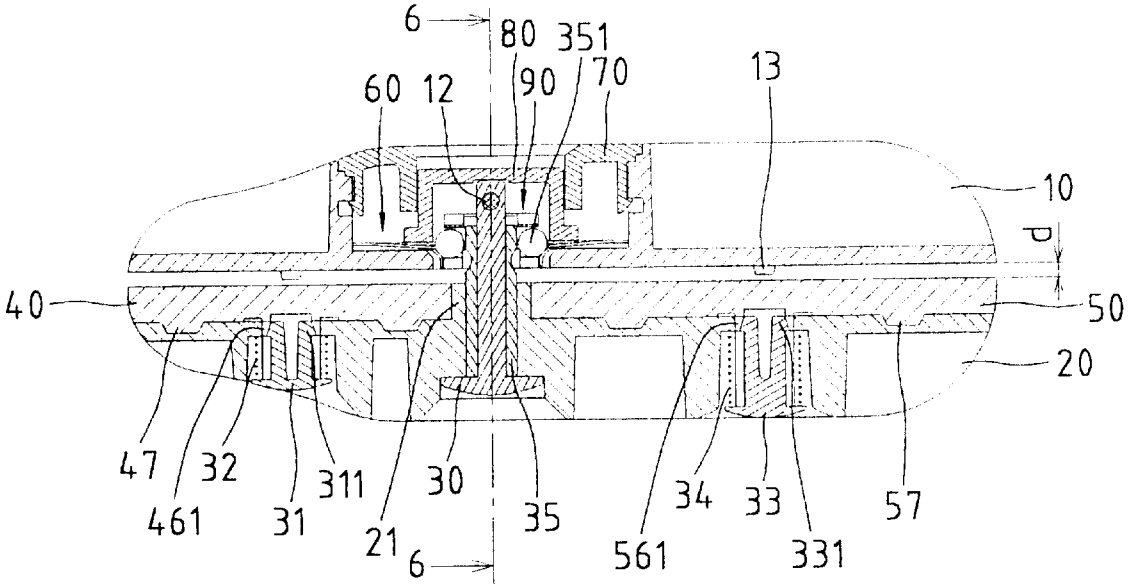
FIG. 5 is a view similar to FIG. 3, wherein the upper body and the lower body of the hook screw driver are disengaged.
Figure 7:
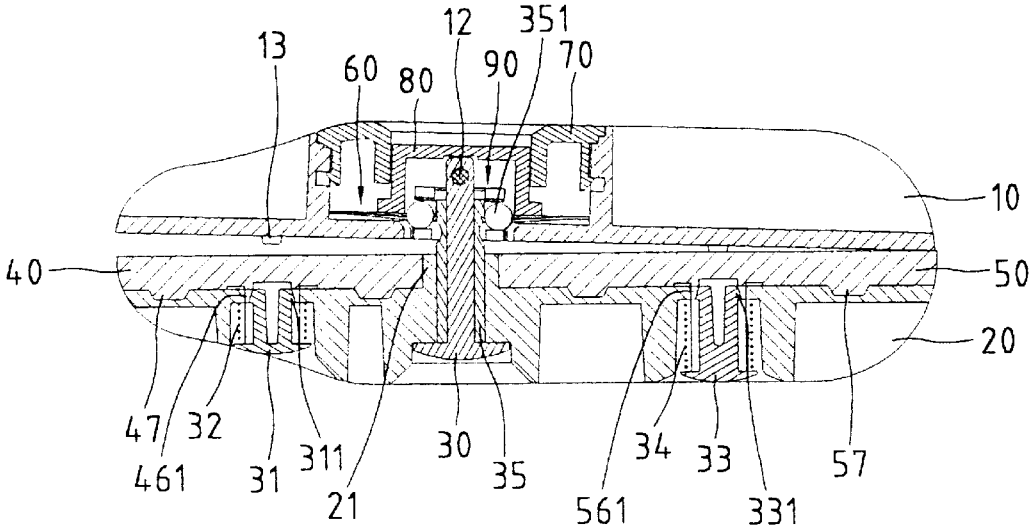
FIGS. 7 and 8 are schematic side views, partly in section, illustrating operation of the hook screw driver.
Figure 8:
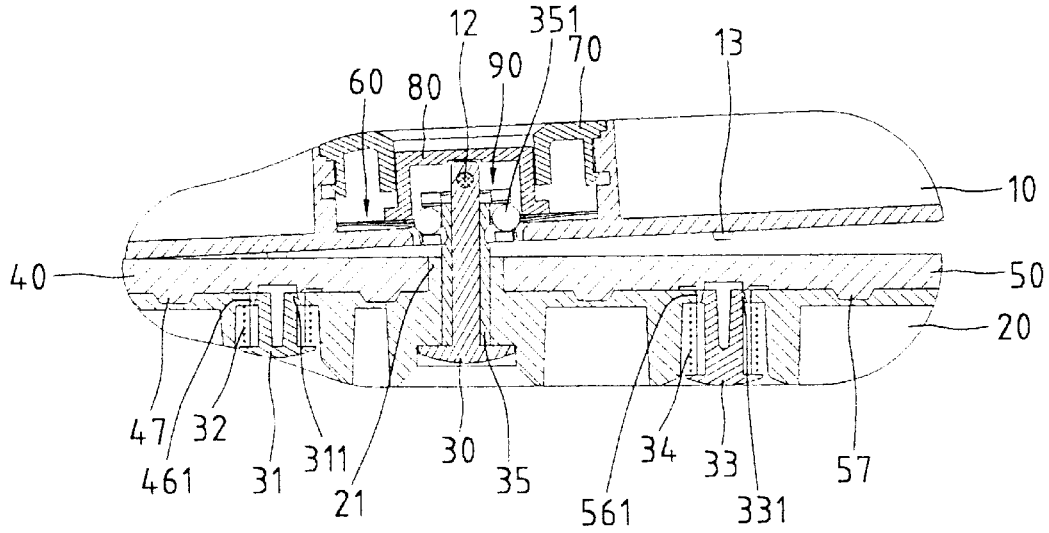
Figure 9:
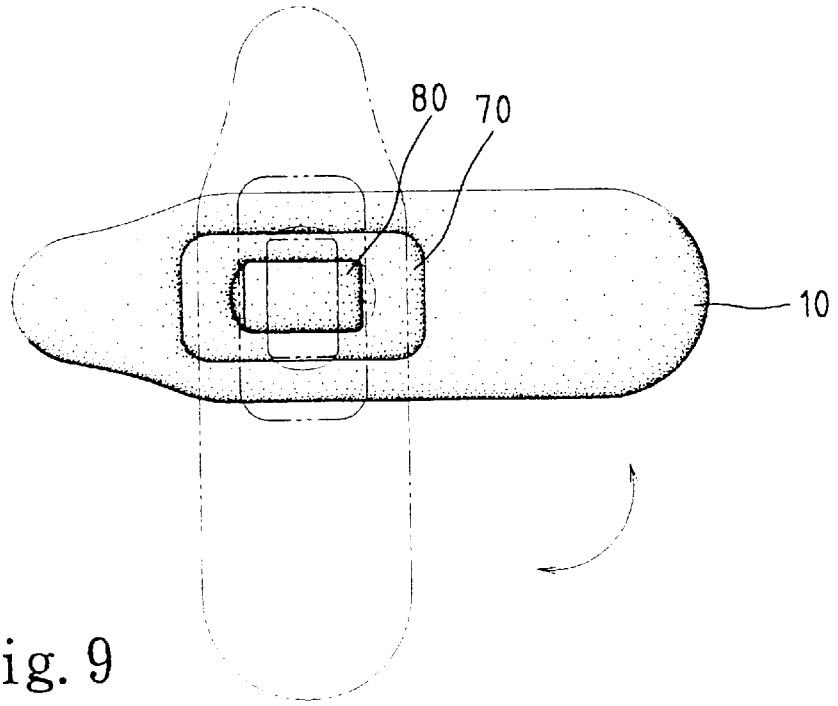
FIG. 9 is a schematic top view illustrating rotational movement of the upper body relative to the lower body of the hook screw driver.
Figure 13:
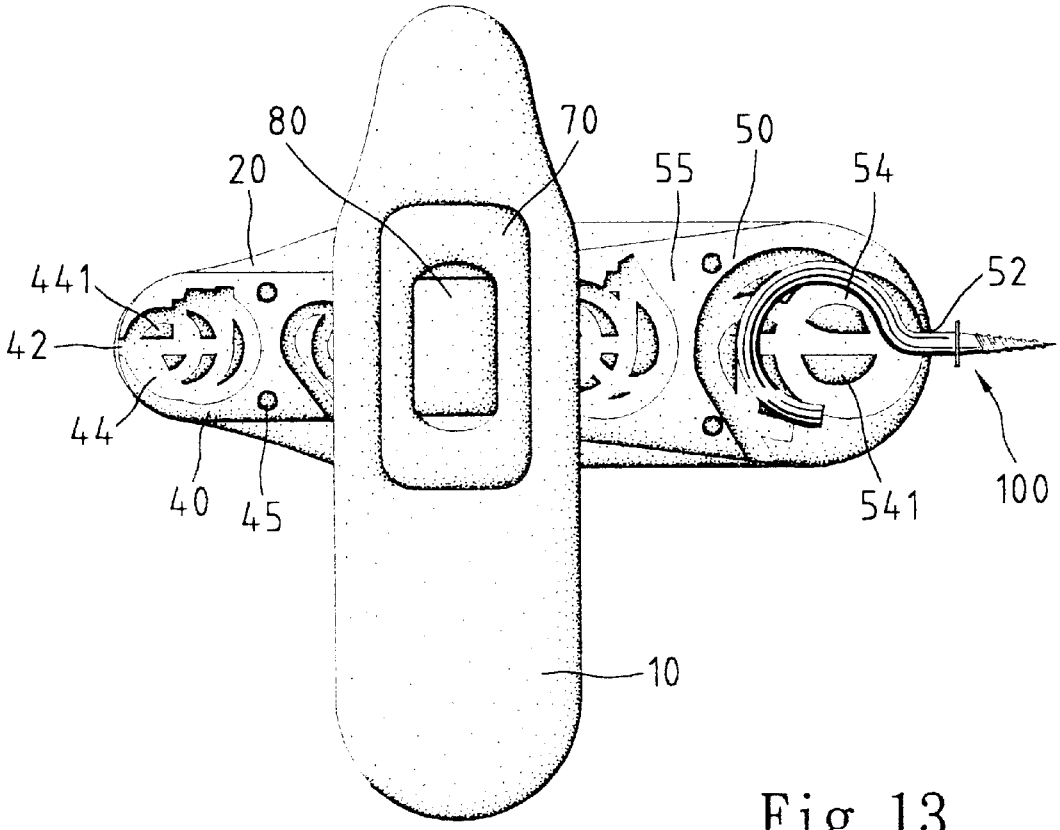
FIG. 13 is a view similar to FIG. 12, illustrating receiving of a hook screw.

In use, the user may simultaneously press the actuating member 80 and the enlarged head 302 of the plug 30 that has a distance "d" from the lower side of the lower body (FIG. 3). As shown in FIGS. 5 and 6, the steel balls 351 are moved away from the annular groove 352 and contact with the inclined surfaces 611. The upper and lower bodies 10 and 20 are thus disengaged and have a distance "d" therebetween. The upper body 10 may be rotated through 90° (FIG. 9) to reveal the retaining sections 44 and 54 on the first and second discs 40 and 50 (FIG. 10) for receiving a hook portion (not labeled) of the hook screw 100 (FIG. 13). As shown in FIG. 13, a screw end of the hook screw 100 is extended beyond the lower body 20 via the notch 52. The upper body 10 is then rotated back to be aligned with the lower body 20 (FIG. 14), and the user may press the right parts (FIG. 7) or the left parts (FIG. 8) of the hook screw driver to change the engaging relationship between the upper body 10 and the lower body 20 to the status shown in FIG. 3 in which the upper body 10 is again securely engaged with the lower body 20 and thus not rotatable. This is because the steel balls 351 are restrained between the legs 91 and the recessed sections 92 of the press plate 90 as well as the extensions 61 of the elastic plate 60. Thus, when the user applies a force on, e.g., the right parts (FIG. 7) of the upper and lower bodies 10 and 20, the steel balls 351 are pushed toward the sleeve 35 by the inclined surfaces 611 of the elastic member 60 and thus partially received in the annular groove 352, as shown in FIG. 3. It is appreciated that the actuating member 80 is returned to its initial position by the elastic legs 62 of the elastic member 60. As a result, the hook portion of the hook screw 100 is securely held between the upper and lower bodies 10 and 20. The hook screw 100 can be threaded into a wooden wall upon manual rotational operation on the hook screw driver. After completion of mounting the hook screw onto the wooden wall, the user may press the plug 30 again to separate the upper body 10 from the lower body 20 to disengage the hook screw driver from the hook portion of the hook screw 100 which is now left on the wooden wall.

Figure 10:
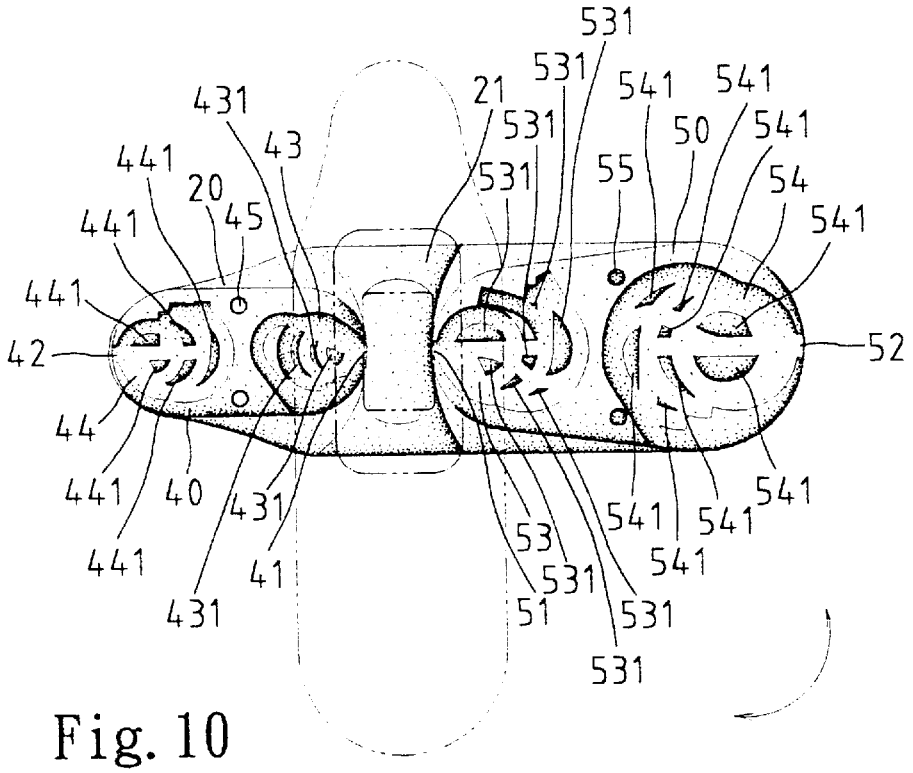
FIG. 10 is a schematic top view of the hook screw driver, wherein the upper body is rotated through an angle to reveal at least one retaining section on the lower body for retaining a hook screw, the upper body being shown by phantom lines for clarity.
Figure 11:
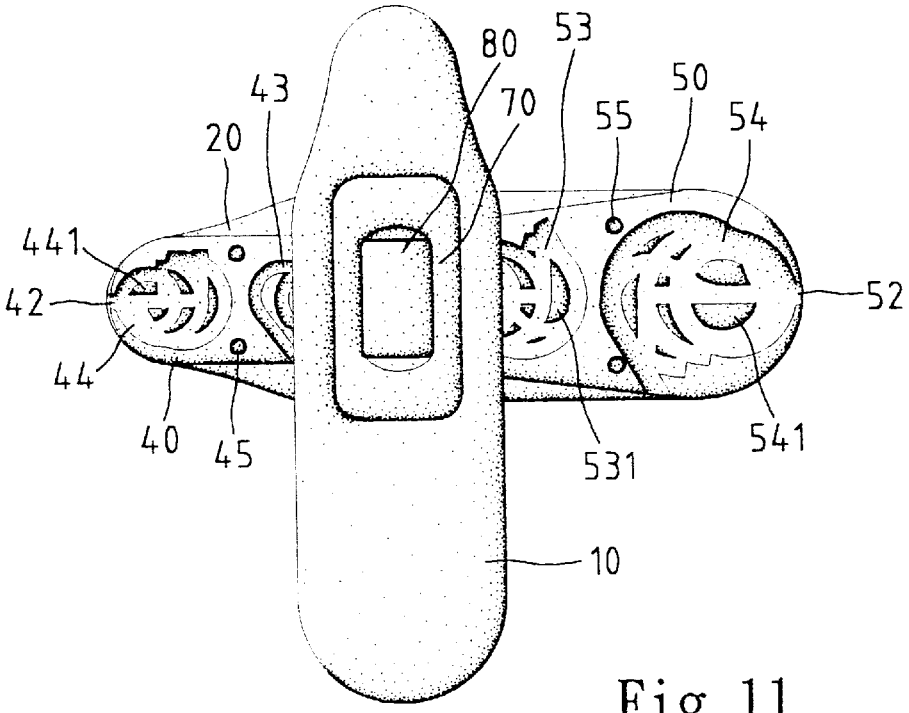
FIG. 11 is a schematic top view similar to FIG. 10, wherein the upper body is shown by solid lines.
Figure 12:
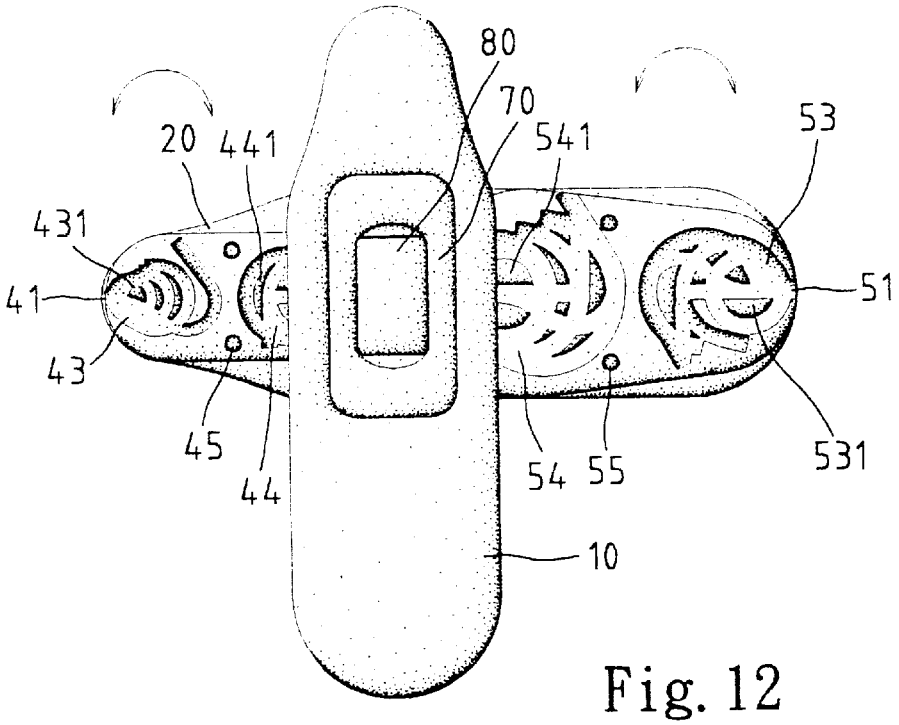
FIG. 12 is a schematic top view similar to FIG. 11, wherein the first disc and the second disc of the hook screw driver are rotated for retaining hook screws of different sizes.

If the retaining sections 44 and 54 on the first and second discs 40 and 50 do not have the proper patterns for securely retaining the hook portion of the hook screw 100, the first and second discs 40 and 50 are both rotatable (FIGS. 11 and 12) to provide further selections for the user when the upper body 10 is perpendicular to the lower body 20 (FIG. 10). It is appreciated that the first and second discs 40 and 50 are made of plastic material, and the retaining blocks 431, 441, 531, and 541 are made of elastic material to securely hold the hook portion of the hook screw 100 without causing damage.

According to the above description, it is appreciated that the hook screw driver may be applied to hook screws of numerous sizes and the operation thereof is simple.

Although the invention has been explained in relation to its preferred embodiment, it is to be understood that many other possible modifications and variations can be made without departing from the spirit and scope of the invention as hereinafter claimed.

What is claimed is:

1. A hook screw driver, comprising an upper body (10) and a lower body (20), one of the upper body and the lower body including a retaining section (43; 44; 53; 54) having a pattern formed thereon, the pattern being constructed by a plurality of spaced blocks (431; 441; 531; 541) that constitute a plurality of grooves adapted to securely retain a hook portion of a hook screw, and means for disengagably engaging the upper body with the lower body, said engaging means being movable between a first position in which the upper body and the lower body are retained in a disengaged status such that the upper body and the lower body are rotated relative to each other to reveal the retaining section for receiving the hook portion of the hook screw and a second position in which the upper body and the lower body are retained in an engaged relationship to securely hold the hook portion of the hook screw.

2. A hook screw driver, comprising an upper body (10) and a lower body (20), one of the upper body and the lower body including a disc (40; 50) rotatably mounted thereon, the disc including a first retaining section (43; 53) having a first pattern formed thereon and a second retaining section (44; 54) having a second pattern formed thereon and different from the first pattern, each of the first pattern and the second pattern being constructed by a plurality of spaced blocks (431; 531; 441; 541) that constitute a plurality of grooves adapted to securely retain a hook portion of a hook screw, and means for disengagably engaging the upper body with the lower body, said engaging means being movable between a first position in which the upper body and the lower body are retained in a disengaged status such that the upper body and the lower body are rotated relative to each other to reveal the retaining section for receiving the hook portion of the hook screw and a second position in which the upper body and the lower body are retained in an engaged relationship to securely hold the hook portion of the hook screw.

3. A hook screw driver, comprising an upper body (10) and a lower body (20), the lower body including two ends and a mediate section (21) that includes a through hole (212) and two receptacles (211) formed on two sides of the through hole, respectively, a first disc (40) and a second disc (50) are respectively, rotatably mounted on the two ends of the lower body (10), the first disc (40) including a first retaining section (43) and a second retaining section (44) formed on an upper side thereof, the second disc (50) including a third retaining section (53) and a fourth retaining section (54) formed on an upper side thereof, the first retaining section, the second retaining section, the third retaining section and the fourth retaining section respectively having a first pattern, a second pattern, a third pattern, and a fourth pattern formed thereon and different from one another, each of the first pattern, the second pattern, the third pattern, and the fourth pattern being constructed by a plurality of spaced blocks (431, 441, 531, 541) that constitute a plurality of grooves adapted to securely retain a hook portion of a hook screw, the upper body (10) including a compartment (11) in an upper side thereof and defined by a bottom wall (111), two lateral walls, and two end walls, the bottom wall (111) further includes a hole (116), an elastic member (60) being mounted in the compartment (11) and having two ends respectively attached to the end walls of the compartment (11), the elastic member (60) further including a central opening (63), two mutually facing extensions (611), and four legs (62) respectively extended from four corners thereof, a ball (22) being mounted in each said receptacle (211), and a spring (23) being mounted in each said receptacle (211) for biasing the ball (22) upwardly, a sleeve (35) being slidably received in the through hole (212) of the lower body and including an upper end extended into the compartment (11) of the upper body via the hole (116) of the upper body, the sleeve (35) including an outer annular groove (352) defined in the upper end thereof, a plug (30) being slidably mounted in said sleeve (35) and including a lower end (302) and an upper end secured to the upper body (10) to move therewith, two steel balls (351) being partially yet disengagably received in the outer annular groove (352) of the sleeve (35) and restrained by the extensions (61) of the elastic member 60, a cover (70) being mounted to enclose the compartment (11) of the upper body and including a chamber (71), and an actuating plate (80) being slidably received in the chamber (71) of the cover (70) and engaged with the upper end of the sleeve (35), whereby when the actuating member (80) and the lower end (302) of the plug (30) are pressed, the steel balls (351) are disengaged from the annular groove (352) of the sleeve (35) and thus causes disengagement of the upper body from the lower body to allow relative rotational movement therebetween to reveal at least one of the first retaining section, the second retaining section, the third retaining section, and the fourth retaining section and to allow rotational movements of the first disc and the second disc relative to the lower body, and when the steel balls (351) are partially received in the annular groove (352) of the sleeve (35), the upper body and the lower body are engaged with each other such that relative rotational movement therebetween is prevented, and rotational movements of the first disc and the second disc relative to the lower body are also prevented.

4. The hook screw driver according to claim 3, wherein the first disc (40) includes a tubular member (46) formed on an underside thereof, and one of the two ends of the lower body (20) includes a through hole (26) for rotatably receiving the tubular member (46).

5. The hook screw driver according to claim 4, further comprising a spring (32) received in the through hole (26) of the lower body (40) and around the tubular member (46), and an end cap (31) mounted to enclose the through hole (26).

6. The hook screw driver according to claim 5, wherein the end cap (31) includes a snapping fastener (311) extended into the through hole (26) of the lower body (20).

7. The hook screw driver according to claim 4, wherein the second disc (50) includes a second tubular member (56) formed on an underside thereof, and the other one of the two ends of the lower body (20) includes a second through hole (27) for rotatably receiving the second tubular member (56).

8. The hook screw driver according to claim 7, further comprising a spring (34) received in the second through hole (27) of the lower body (40) and around the second tubular member (56), and an end cap (33) mounted to enclose the second through hole (27).

9. The hook screw driver according to claim 8, wherein the end cap (33) includes a snapping fastener (331) extended into the second through hole (27) of the lower body (20).

* * * * *